US007024140B2

(12) United States Patent
Masuda et al.

(10) Patent No.: US 7,024,140 B2
(45) Date of Patent: Apr. 4, 2006

(54) TONER FEEDER, TONER, AND ELECTROPHOTOGRAPHIC IMAGE FORMING APPARATUS USING THE TONER FEEDER AND TONER

(75) Inventors: Minoru Masuda, Numazu (JP); Hideki Sugiura, Fuji (JP); Kazuhiko Umemura, Suntou-gun (JP); Tomomi Suzuki, Numazu (JP); Satoshi Mochizuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 91 days.

(21) Appl. No.: 10/752,589

(22) Filed: Jan. 8, 2004

(65) Prior Publication Data

US 2004/0197117 A1 Oct. 7, 2004

(30) Foreign Application Priority Data

Jan. 9, 2003 (JP) ..... 2003-003171

(51) Int. Cl.
*G03G 15/08* (2006.01)

(52) U.S. Cl. ..... 399/258; 399/260

(58) Field of Classification Search ..... 399/252, 399/258, 259, 260; 430/110, 111, 124, 126, 430/137

See application file for complete search history.

(56) References Cited

U.S. PATENT DOCUMENTS

| | | | | |
|---|---|---|---|---|
| 5,885,743 | A | 3/1999 | Takayanagi et al. | |
| 5,953,567 | A * | 9/1999 | Muramatsu et al. | 399/256 |
| 6,096,468 | A * | 8/2000 | Ohno et al. | 430/108.3 |
| 6,112,046 | A * | 8/2000 | Suzuki et al. | 399/359 |
| 6,159,647 | A | 12/2000 | Anno et al. | |
| 6,291,123 | B1 | 9/2001 | Ohno et al. | |
| 6,303,258 | B1 | 10/2001 | Katoh et al. | |
| 6,356,729 | B1 | 3/2002 | Sasaki et al. | |
| 6,406,826 | B1 | 6/2002 | Suzuki et al. | |
| 6,447,973 | B1 | 9/2002 | Asami et al. | |
| 6,493,529 | B1 | 12/2002 | Umemura et al. | |
| 6,500,595 | B1 | 12/2002 | Mochizuki et al. | |
| 6,503,676 | B1 | 1/2003 | Yamashita et al. | |
| 6,630,276 | B1 | 10/2003 | Sugiura et al. | |
| 2001/0044059 | A1 | 11/2001 | Miyamoto et al. | |
| 2002/0098436 | A1 | 7/2002 | Miyamoto et al. | |

FOREIGN PATENT DOCUMENTS

| | | |
|---|---|---|
| EP | 0 475 332 | 3/1992 |
| EP | 0 886 187 | 12/1998 |
| EP | 1 087 265 | 3/2001 |
| EP | 1 253 480 | 10/2002 |
| JP | 2002-139902 | 5/2002 |
| JP | 2002-139906 | 5/2002 |
| JP | 2002-287497 | * 10/2002 |
| JP | 2003-005428 | 1/2003 |

OTHER PUBLICATIONS

Patent Abstracts of Japan, JP 2003-005428, Jan 8, 2003.

* cited by examiner

*Primary Examiner*—Hoan Tran
(74) *Attorney, Agent, or Firm*—Oblon, Spivak, McClelland, Maier & Neustadt, P.C.

(57) ABSTRACT

A toner including toner powders having an aggregation not greater than 20% and circularity not less than 0.93.

2 Claims, 8 Drawing Sheets

TONER FEEDER, TONER, AND ELECTROPHOTOGRAPHIC IMAGE FORMING APPARATUS USING THE TONER FEEDER AND TONER

BACKGROUND OF THE INVENTION

1. Field of the Invention

The present invention relates to an image forming apparatus such as printers, facsimiles and copiers using electrophotographic image forming methods, and more particularly to a toner feeder, a toner, and an electrophotographic image forming apparatus using the toner feeder and toner.

2. Discussion of the Background

For example, the following toner feeding methods are conventionally known:

(1) a method of feeding a toner with a coil screw arranged in a pipe formed between a sender and a receiver; (2) a method of feeding a toner mostly by gravity while closely locating a sender and a receiver above and below; and (3) a method of feeding a toner from a sender to receiver optionally located through a pipe with a pressure applied by a powder pump as disclosed in, e.g., Japanese Laid-Open Patent Publications Nos. 2002-139906 and 2002-139902.

Each of the above-mentioned methods (1) and (2) are significantly limited by the relative position of the sender and receiver, and have many disadvantages, e.g., not suitable for a long-distance feeding. Now, the above-mentioned toner feeding method (3) has fewer problems and attracts attention. Particularly, as an electrophotographic image forming apparatus has a toner container with a larger volume, the toner feeding method (3) permits more freedom for layout and saves space in a place where the electrophotographic image forming apparatus is used. Particularly, a full-color electrophotographic image forming apparatus using four color toners and the toner feeding method (3) has an advantage in terms of the layout and space-saving.

However, even the toner feeding method (3), because a sender and a receiver are connected with a pipe, etc., a toner blockage in the pipe may occur. When the toner blockage occurs, a toner cannot be fed, resulting in a serious problem for a whole system. Thus, the pipe is shortened to prevent occurrence of the toner blockage, resulting a limitation to the layout freedom. In addition, the toner feeding method (3) has an unstable toner feeding speed, resulting in complicated control thereof. Further, when the toner passes through the powder pump, the toner deteriorates due to a friction therewith and produces foggy images.

Consequently, there is still need for a toner feeder, a toner and an electrophotographic image forming apparatus using the toner feeder and toner, which permit a larger layout freedom and simply control feeding a stable amount of a toner without toner blockage.

SUMMARY OF THE INVENTION

According to one aspect of the present invention, a toner includes toner powders having an aggregation not greater than 20% and circularity not less than 0.93.

According to another aspect of the present invention a toner feeder includes a container for containing a toner including comprising toner powders having an aggregation not greater than 20% and circularity not less than 0.93, a pipe for transporting the toner, and a pump for feeding the toner from the container through the pipe.

According to yet another aspect of the present invention, an electrophotographic image forming apparatus includes a photoreceptor, a charger for charging the photoreceptor, an irradiator for irradiating the photoreceptor with light to form an electrostatic latent image on the photoreceptor, an image developer for developing the electrostatic latent image with a developer including a toner including toner powders having an aggregation not greater than 20% and circularity not less than 0.93, and a toner feeder including a container for containing the toner, a pipe for transporting the toner, and a pump for feeding the toner from the container through the pipe, wherein the pump feeds the toner to the image developer through the pipe.

BRIEF DESCRIPTION OF THE DRAWINGS

Various objects, features and attendant advantages of the present invention will be fully appreciated as the same becomes better understood from the detailed description when considered in connection with the accompanying drawing(s) in which like reference characters designate like corresponding parts throughout and wherein.

DETAILED DESCRIPTION OF THE INVENTION

Figure 1:
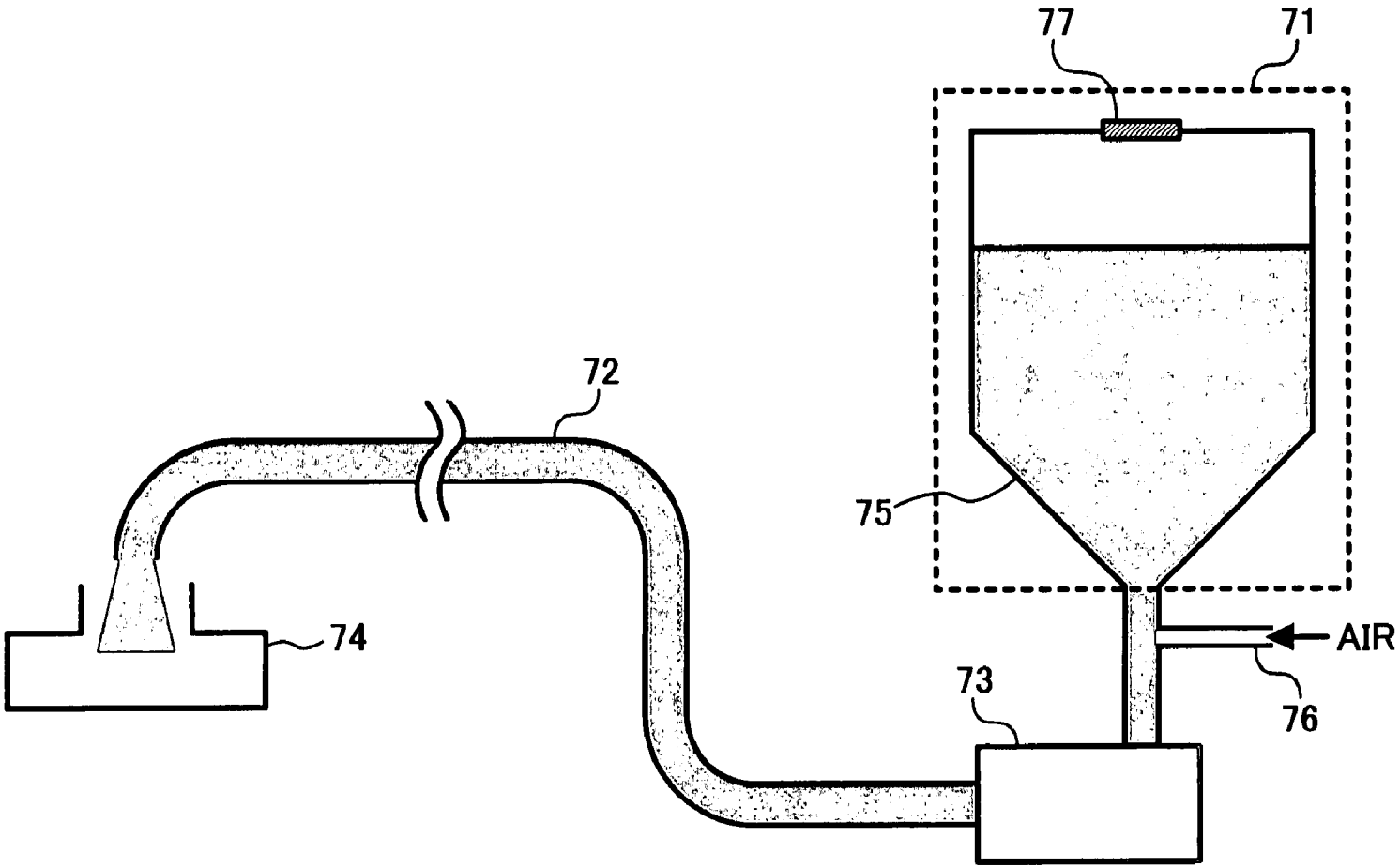
FIG. 1 is a schematic view illustrating an embodiment of the toner feeder of the present invention, using a discharge powder pump.

Generally, the present invention provides a toner feeder, a toner and an electrophotographic image forming apparatus using the toner feeder and toner, which permit a larger layout freedom and simply control feeding a stable amount of a toner without toner blockage without producing foggy images.

A toner feeder according to the present invention has a large layout freedom, is freely handled in an electrophotographic image forming apparatus and is simply installed therein. In addition, the toner feeder has a simple structure and can be downsized to save space, and deteriorates a toner less because of giving less stress thereto.

A toner according to the present invention has a small aggregation, has good fluidity, and can be fed through a long feeding pipe without blockage thereof. In addition, the toner according to the present invention has a specific circularity and avoids packing (concavities and convexities of the toners engage with one another) in the feeding pipe, and thus the toner blockage therein does not occur. Further, the toner has less concavity and convexity, making a feeding speed thereof stable. Because of the stable feeding speed, even when a two-component developer is used, a toner concentration in an image developer can be controlled by an operation time of a powder pump.

An electrophotographic image forming apparatus according to the present invention has a large layout freedom, and simply and stably feeds a toner without the toner blockage. In addition, even when a two-component developer is used, a toner concentration in an image developer can be controlled by an operation time of a powder pump because of the stability of the feeding speed.

Hereinafter, embodiments of the present invention will be explained, referring to the drawings.

Figure 2:
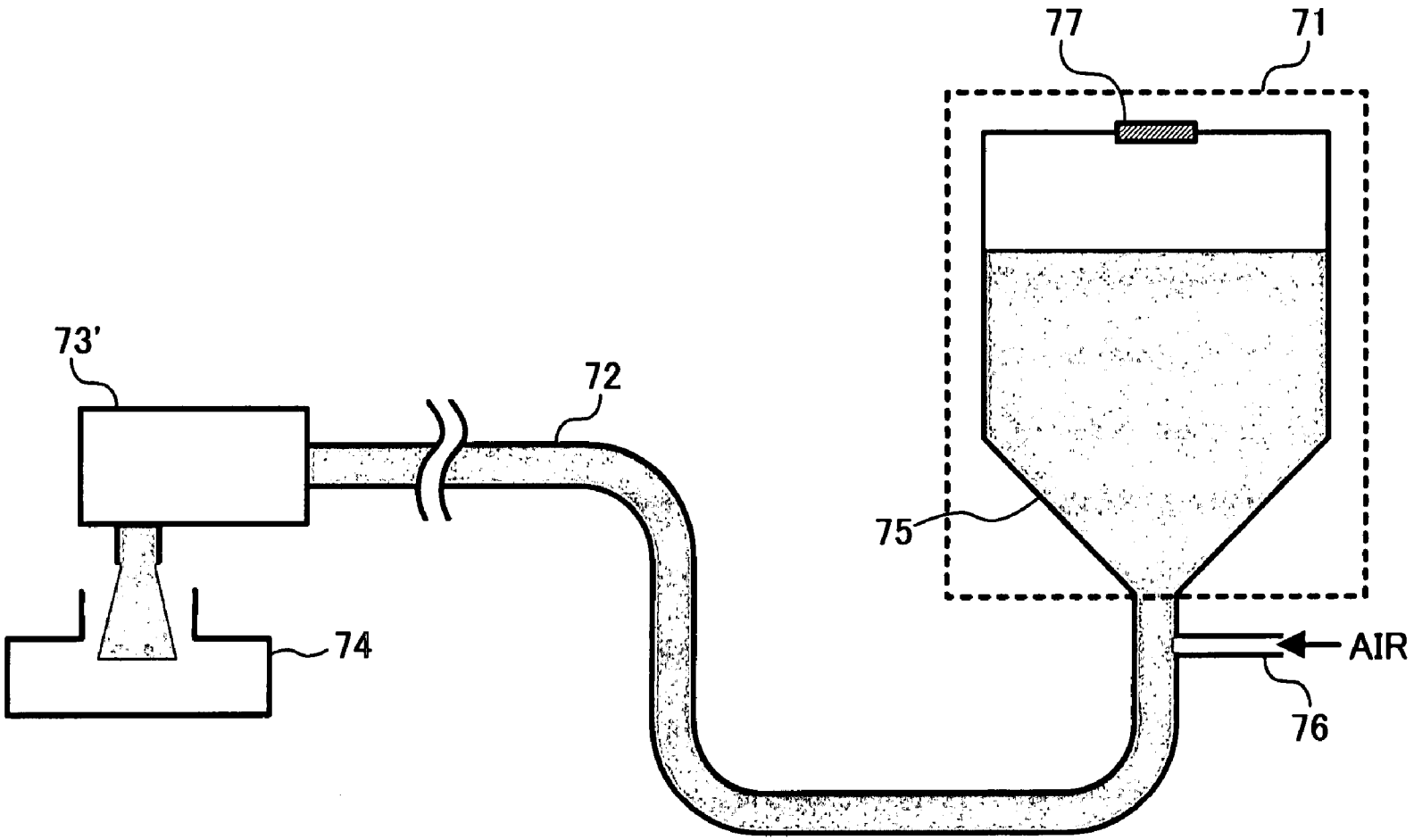
FIG. 2 is a schematic view illustrating an embodiment of the toner feeder of the present invention, using a suction powder pump.

Each of the FIGS. 1 and 2 shows a schematic view illustrating an embodiment of the toner feeder arranged in an electrophotographic image forming apparatus of the present invention.

In FIGS. 1 and 2, a toner container 71 is connected to a toner receiver 74 with a toner feeding pipe 72, and a toner is fed to the toner receiver 74 from the toner container 71 with a pressure applied by a powder pump 73. In FIG. 1, a discharge powder pump 73' installed close to the toner container 71 applies a pressure to the toner feeding pipe 72 to feed the toner. In FIG. 2, a suction powder pump 73 installed close to the toner container 71 applies a suction pressure to the toner feeding pipe 72 to feed the toner. In the present invention, either the discharge or the suction powder pump can be used to feed the toner.

The toner container 71 may be detachable from the toner feeding pipe 72. In an electrophotographic image forming apparatus, a detachable toner cartridge is used as the toner container 71 to simply and conveniently feed new toner. As a matter of course, the toner container 71 may be fixed. Not only the new toner but also the toner collected by a cleaner on a photoreceptor of the electrophotographic image forming apparatus in the toner container 71 can be used in the present invention.

A connection point of the toner feeding pipe 72 to the toner container 71 is preferably located on a bottom face thereof because the toner easily enters the toner feeding pipe 72 by gravitation. A bottom 75 of the toner container 71 is conically or multi-pyramidically tapered toward the connection point to the toner feeding pipe 72 such that less toner remains in the toner container 71.

When air is taken into the toner container 71 or a stirring blade therein stirs the toner, the toner is fluidized and easily enters into the toner feeding pipe 72. Particularly when air is taken in through an air intake 76 located on the toner feeding pipe 72 close to the toner container 71 as shown in FIGS. 1 and 2, the toner stably enters into the toner feeding pipe 72.

The toner feeding pipe 72 can be formed by a material either with or without elasticity. When the toner feeding pipe 72 is formed by an elastic rubber, the toner feeding pipe 72 can flexibly be handled like a rubber tube in an electrophotographic image forming apparatus and can easily be installed therein.

The toner feeding pipe 72 preferably has an inner cross-sectional area of from 0.05 to 1.00 $cm^2$, and more preferably from 0.1 to 0.5 $cm^2$. When the toner feeding pipe 72 is too thick, an inner volume thereof is too large for the air or toner amount flown by a powder pump and a pressure in the toner feeding pipe 72 decreases, and therefore the toner is not smoothly fed. When the toner feeding pipe 72 is too thin, a friction between the toner and an inner wall of the toner feeding pipe 72 becomes large, and therefore the toner is not smoothly fed, either. The inner wall of the toner feeding pipe 72 preferably has a high smoothness and less friction with the toner. A cross section of the toner feeding pipe 72 may have any shape, and preferably has a circularity because the inner wall area is small and the toner feeding resistance decreases. In addition, the toner feeding pipe 72 preferably has a length not longer than 2 m, and more preferably not longer than 1 m. In FIGS. 1 and 2, Reference Numeral 77 is an air filter.

Next, the powder pumps 73 and 73' in FIGS. 1 and 2 will be explained.

The powder pump 73 is a discharge pump and the powder pump 73' is a suction pump. Any pumps generating a compression pressure or a suction pressure can be used, and a piston pump with a valve can also be used.

In the present invention, a powder pump commonly known as a mohno pump using a screw pump having a female screw stator with a double pitch spiral groove inside and a male screw rotor rotatably inserted in the stator, is preferably used because it has a simple structure and a small size, and does not burden and deteriorate the toner.

Figure 3:
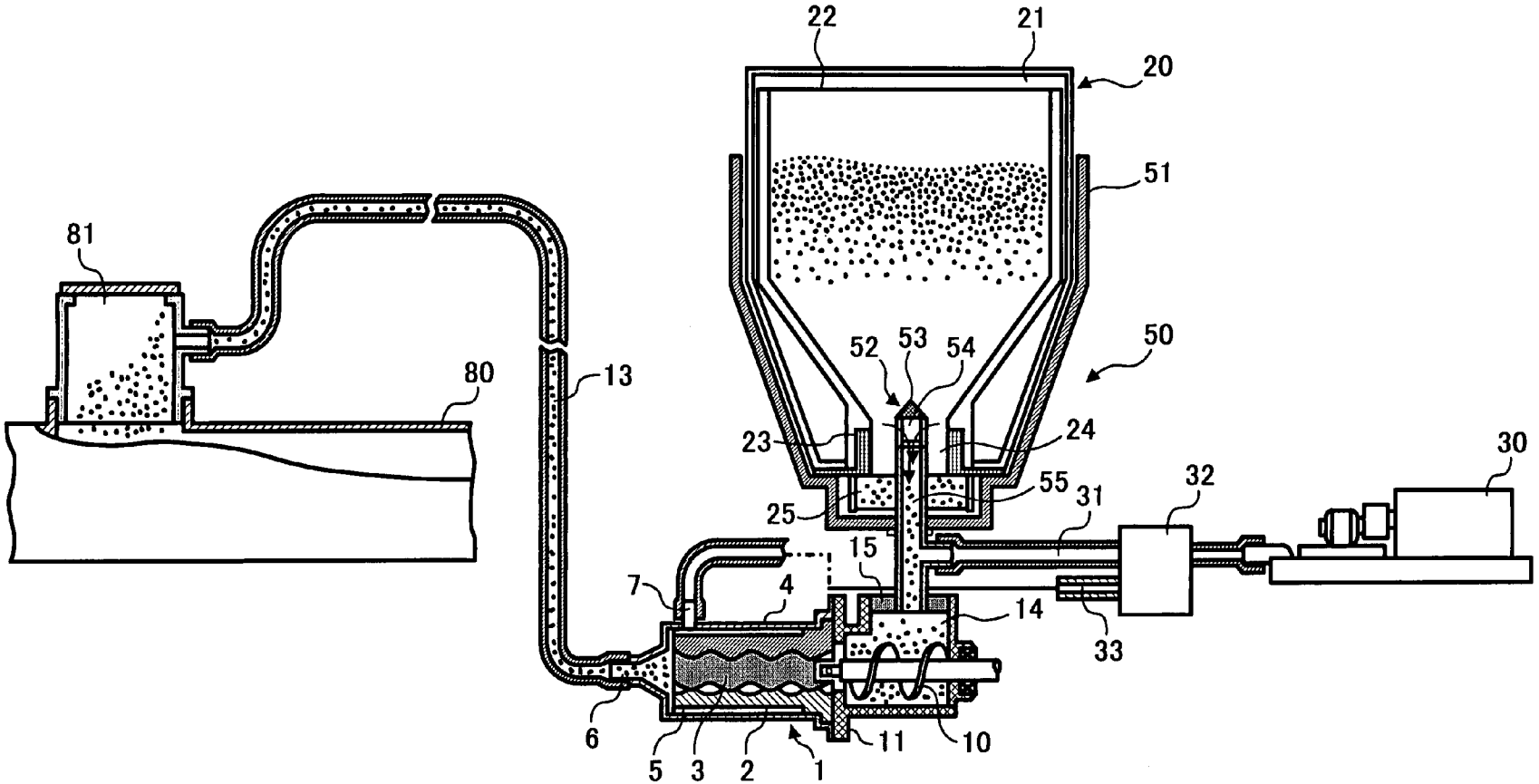
FIG. 3 is a schematic view illustrating a cross section of an embodiment of the toner feeder of the present invention, in which a discharge screw pump is arranged.
Figure 4:
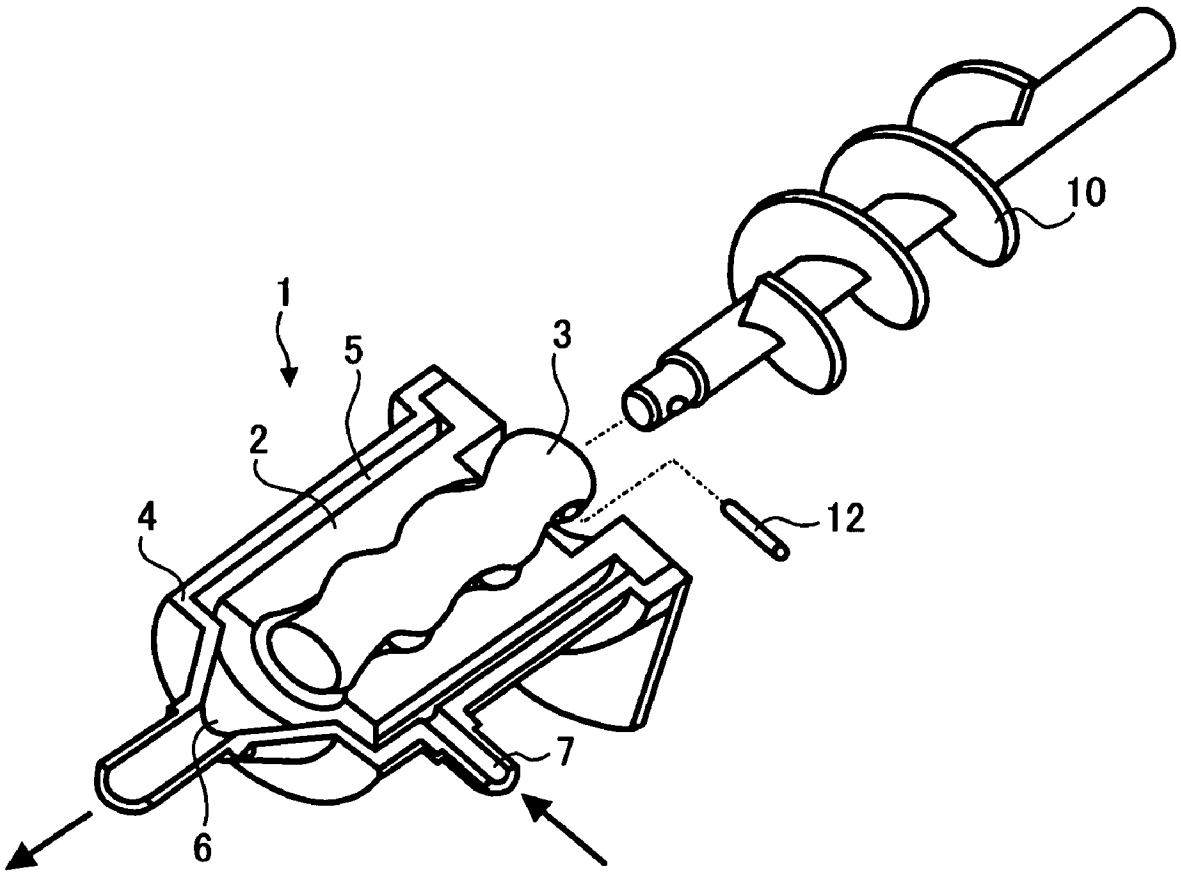
FIG. 4 is a perspective view illustrating a partial cross section of an embodiment of a discharge screw pump arranged in the toner feeder of the present invention.

Embodiments of pumps for the present invention will be explained, referring to the drawings. FIG. 4 is a perspective view illustrating a partial cross section of an embodiment of a discharge screw pump of the present invention. FIG. 3 is a schematic view illustrating a cross section of an exemplary toner feeder of the present invention, including the discharge screw pump. In FIGS. 3 and 4, a screw pump 1 has a female screw stator 2 formed of an elastic material such as rubbers, the female screw stator 2 has a double pitch spiral groove inside, and a male screw rotor 3 formed of a metal and a resin, etc., is rotatably inserted in the stator 2. The stator 2 has its periphery covered by a holder 4 supported by a side board 11, and a gap 5 is formed between an inner surface of the holder 4 and a peripheral surface of the stator 2. The gap 5 is connected to a toner discharge opening 6 located in the downstream of the rotor 3, and the holder 4 has an air supply opening 7 connected to the gap 5. An air supply tube 33 is fitted into the air supply opening 7 from an air pump 30, and air from the air pump 30 is supplied to the toner discharge opening 6 from the air supply opening 7 through the gap 5.

The rotor 3 is connected to a shaft of a feeding screw 10 with a spring pin 12, etc., and is rotated while the feeding screw 10 is rotated by a drive unit (not shown). When the rotor 3 rotates, a discharge pressure is generated to feed the toner fed by the feeding screw 10. Then, air is supplied from the air pump 30 to the toner discharge opening 6 from the air supply opening 7 through the gap 5 to fluidize the toner, and smoothly and reliably discharge the toner in the direction of an arrow with a discharge pressure of the screw pump 1.

A feeding tube 13 has an end fitted into a toner receiver 81 of an image developer 80 and the other end fitted into the toner discharge opening 6. The feeding tube 13 is preferably formed of a flexible rubber tube having an inner diameter of from 3 to 7 mm, such as polyurethane, nitrile, EPDM and silicone. Free piping can be made with the flexible tube. A toner container 20 is a bag-in-box type container including an outer box 21 as a protection case and a flexible and deformable toner bag 22 detachably contained in the outer box 21. The outer box 21 is formed of a paper with a stiffness, a cardboard, a resin, etc. and has an inner space so as to contain the toner bag 22 leaving no space there between. The toner container 20 not only protects the flexible toner bag 22 containing the toner in the outer box 21 but also improves handling and storing of the container.

The toner bag 22 is a closed bag without air out or in, which is formed of a single layer or a multilayer of a flexible sheet material such as polyester and polyethylene films having a thickness of from about 80 to 125 μm. The toner bag 22 has a toner discharge hole 24 on the bottom, which is fixed by a mouth piece 23 formed of resins such as polyethylene and nylon. The toner discharge hole 24 fixed by the mouth piece 23 has a single layer or a multilayer seal 25 having a role of a self-closing valve. The seal 25 is formed of an elastic material such as unbreathable foam sponges. The toner bag 22 is tapered toward the toner discharge hole 24 such that the toner can be fully discharged.

A setting portion 50 where the toner container is installed has a container holder 51 and a nozzle 52 inserted into the seal 25. The nozzle 52 is a linear cylinder having a socket 54 following to a tip 53. The nozzle 52 has a single-lumen structure inside, having a toner route 55 following to the socket 54. At the lower end of the toner route 55, a case 14 is formed to temporarily store the toner. The side board forms a part of the case 14. On top of the case 14, a filter 15 preventing increase of the pressure therein is formed and the feeding screw 10 is located therein.

Figure 5:
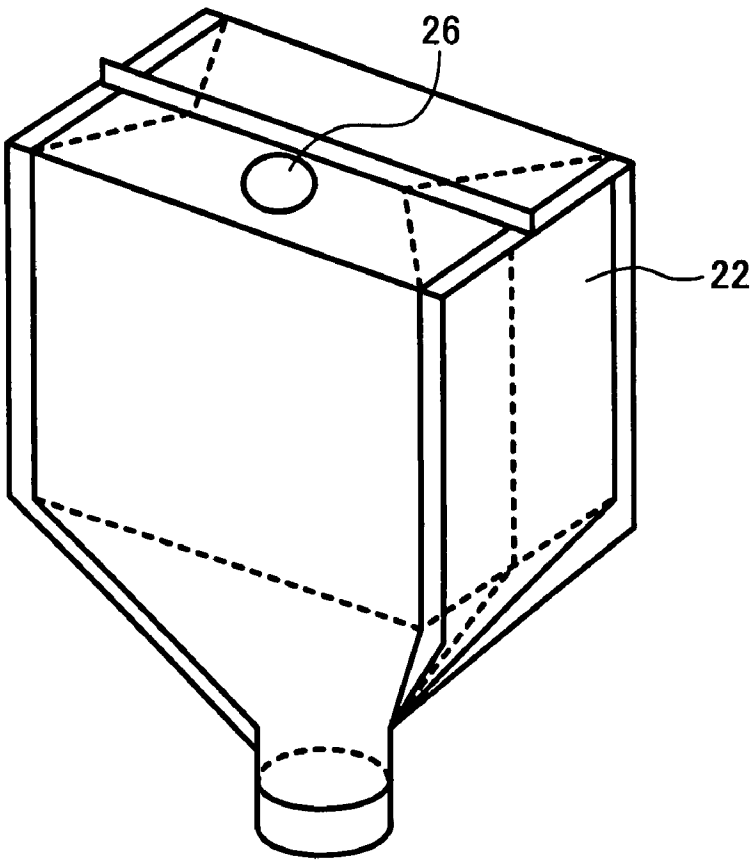
FIG. 5 is a perspective view illustrating a toner container in the toner feeder of the present invention for explaining a breathable filter formed in the toner container.

Air is supplied to the toner container 20 from the air pump 30 through an air tube 31 and the nozzle 52. The air supplied in the toner container 20 stirs and fluidizes the toner therein, so as to prevent a bridge phenomenon of the toner and decrease a residual amount of the toner in the container. As FIG. 5 shows, a breathable filter 26 can be formed on top of the toner container 20. The breathable filter 26 prevents a pressure in the toner container 20 from returning to normal. The air pump 30 has a selector valve 32 before the toner container 20 and the screw pump 1 to supply air to the both thereof.

The thus structured toner feeder is used as a toner feeding apparatus for feeding a toner to the image developer 80.

Figure 6:
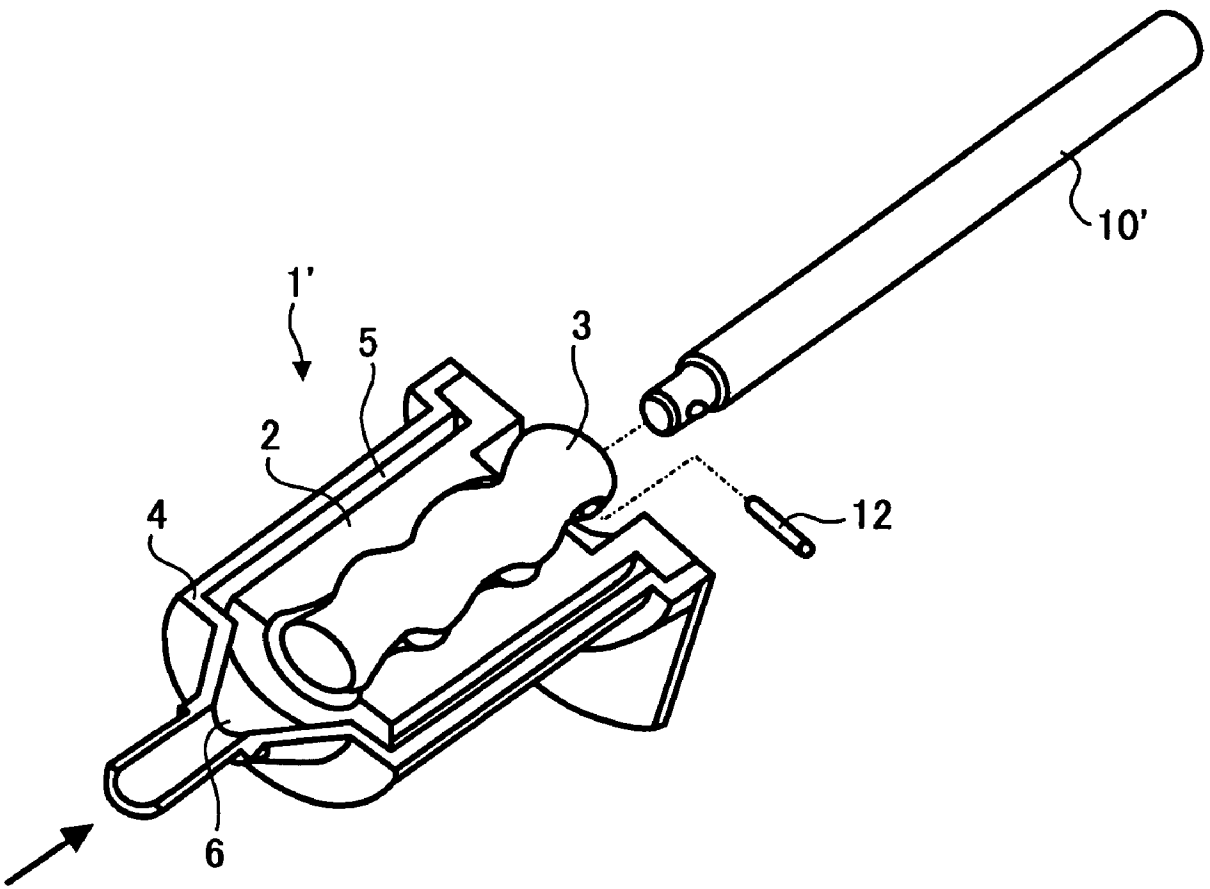
FIG. 6 is a perspective view illustrating a partial cross section of an embodiment of a suction screw pump arranged in the toner feeder of the present invention.

FIG. 6 is the perspective view illustrating a partial cross section of an embodiment of a suction screw pump of the present invention.

The suction screw pump 1' in FIG. 6 is the same discharge screw pump in FIG. 4 except that the feeding screw 10 is replaced by a shaft 10' and the holder 4 does not have the air supply opening 7. When the same rotor 3 and stator 2 in the discharge screw pump 1 are used, the shaft 10' is rotated in the reverse direction of the feeding screw 10 to generate a suction pressure at a toner suction opening 6. The toner suctioned from the toner suction opening 6 is discharged in the direction of the shaft 10'. When the shaft 10' is rotated in the same direction as that of the feeding screw 10, the rotor 3 and stator 2 have reverse winding directions.

The above-mentioned uniaxial eccentric screw pump has the stator 2 made of a rubber, in which the metallic or resin rotor 3 rotates while frictionizes the stator 2 inside. Therefore, an inner diameter of the stator 2 is gradually expanded due to an abrasion as time passes and the discharge or suction pressure thereof decreases.

Figure 7A:
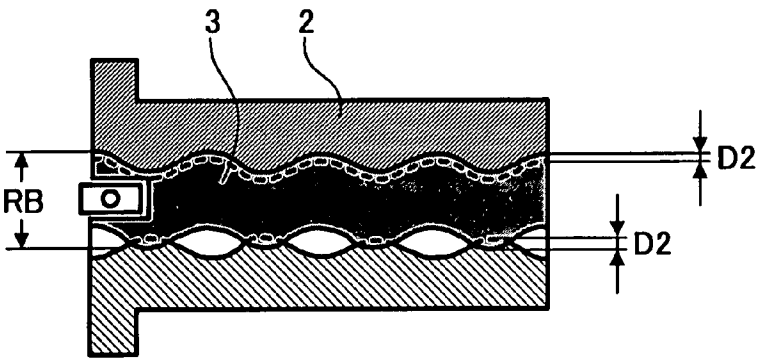
FIGS. 7A, 7B and 7C are schematic views illustrating cross sections of the screw pump of the present invention, in which a rotor is inserted into a stator.
Figure 7B:
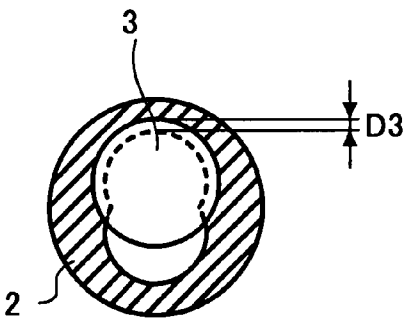
Figure 7C:
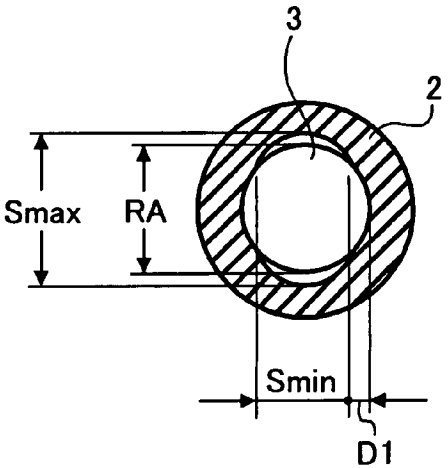

FIGS. 7A, 7B and 7C are schematic views illustrating cross sections of the screw pump according to the present invention, in which the rotor 3 is inserted into the stator 2. Each of D1, D2 and D3 is used as an interlocking amount between the rotor 3 and stator 2 as a matter of convenience. D1 is an interlocking amount between a cross section of the rotor 3 and the minimum inner diameter of the stator 2. D3 is an interlocking amount between the cross section of the rotor 3 and an end (R) of the stator 2. D2 is an interlocking amount between a spiral outer diameter of the rotor 3 and an inner diameter of the stator 2. In the present invention, the interlocking amounts D1, D2 and D3 are essential for the discharge and suction pressure of the screw pumps 1 and 1', respectively.

Figure 8:
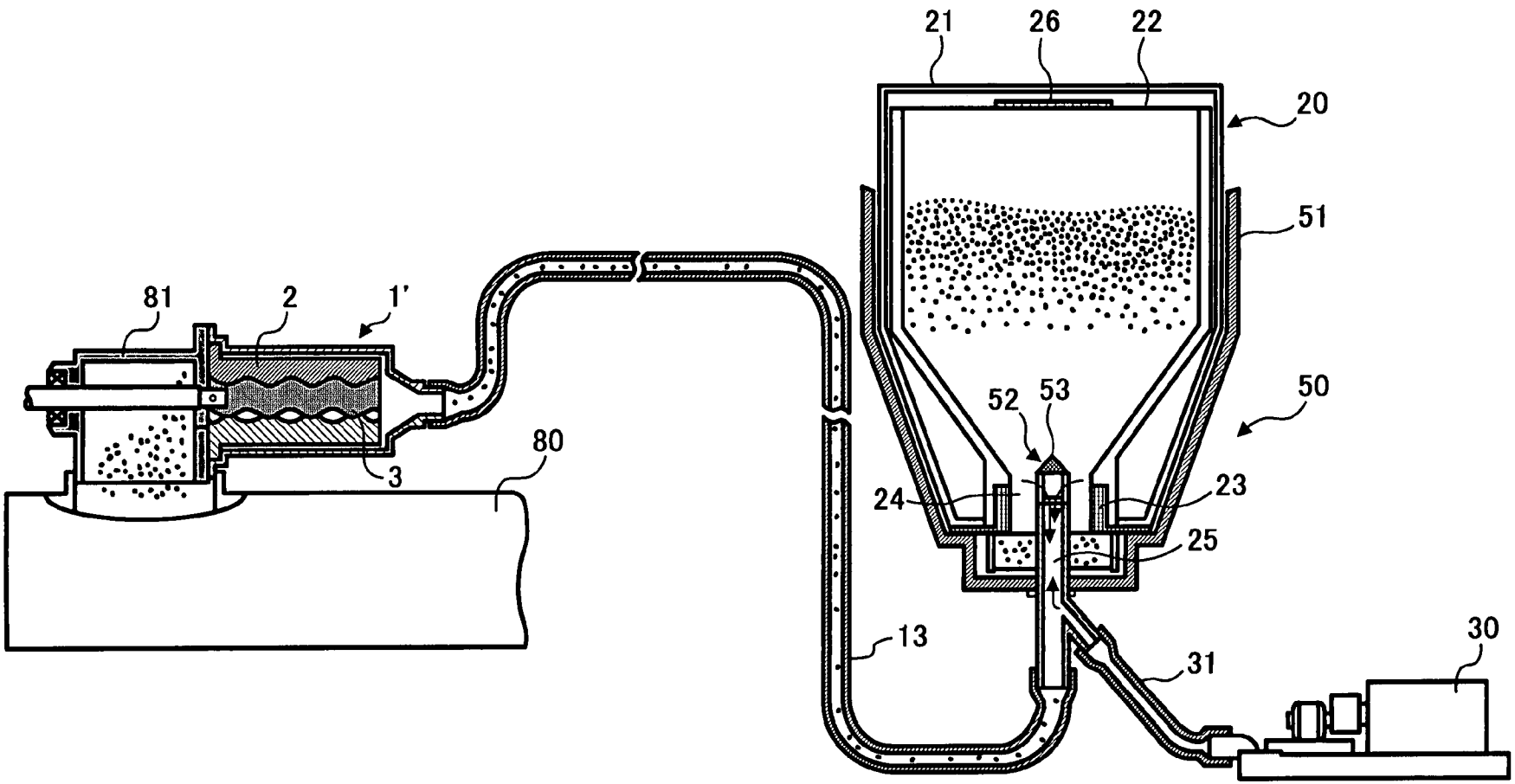
FIG. 8 is a schematic view illustrating a cross section of an embodiment of the toner feeder of the present invention, in which a suction screw pump is arranged.

FIG. 8 is a schematic view illustrating a cross section of an embodiment of the toner feeder of the present invention, including the suction screw pump in FIG. 6. When the suction screw pump is used, the toner feeder has the same structure as the toner feeder in FIG. 3 except that the pump is located at the toner receiver 81 of the image developer 80 and the holder 4 does not have an air supply opening 7.

Next, the toner according to the present invention will be explained.

The toner according to the present invention preferably has an aggregation not greater than 20% and a circularity not less than 0.93, and more preferably an aggregation not greater than 15% and a circularity not less than 0.95. The aggregation and circularity are measured as follows.

Aggregation

On a powder tester from Hosokawa Micron Corp., a sieve Si having an opening of 150 μm, a sieve S2 having an opening of 75 μm and a sieve S3 having an opening of 45 μm are lined in this order from above. 2 g of a toner are put on the sieve S1 having an opening of 150 μm and vibrated for 30 sec at an amplitude of 1 mm to measure each of weights W1, W2 and W3 of the toner remaining on each of the sieves S1, S2 and S3. Then, the aggregation AG (%) is determined by the following formula:

$$AG=[(1.0\times W1+0.3\times W2+0.2\times W3)/2]\times 100$$

Circularity

The circularity is measured by a flow-type particle image analyzer FPIA-2000 from SYSMEX CORPORATION. The toner is diluted by distilled water, and a detergent DRY-WELL from Fuji Photo Film Co., Ltd. is added to the mixture and the mixture is dispersed by an ultrasonic washer.

The circularity is determined by dividing a peripheral length equivalent to a projected area of the toner with a peripheral length P of a projection image of the toner. The flow-type particle image analyzer FPIA-2000 from SYSMEX CORPORATION automatically reads and processes projection images of not less than 1,000 toners to determine an average. Namely, the circularity is 1 or less, the closer to 1, the closer to a sphere and the smaller, the more angular.

The aggregation is a standard to determine aggregation between powders, the lower the value, the more difficult to aggregate. The aggregation is typically related with fluidity of the powder. Lower the aggregation becomes, better the fluidity is. As a matter of course, as the toner is transported in a long tube, better the fluidity is, better the powder transportation becomes without blockage thereof. However, the good fluidity alone is not sufficient, and the circularity is also essential according to the present invention.

The toner in the toner feeding tube is tightly packed because a bulk thereof becomes small due to discharge, a suction pressure or supply air. When a toner having a low circularity, i.e., more angular, is packed, the toners tangle each other (concavities and convexities of the toners are engaged each other) and become difficult to break. Therefore, the toner blockage occurs in the toner feeding tube and has serious influence upon a whole system. Even when there is no toner blockage, transport resistance of the toner becomes large and transport speed thereof significantly changes, making more difficult or less stable to control the system.

When a toner having a high circularity, i.e., more spherical, is packed in the toner feeding tube, the toner quickly breaks off without being engaged because of less concavity and convexity. Therefore, no toner blockage occurs and the toner transport speed becomes more stable.

When the toner transport speed is stable, the toner amount according to an output power of the powder pump is stably transported. For example, since the toner amount in proportion to an operation time of the powder pump can be transported, the toner concentration in a two-component image developer which requires controlling the toner concentration can be controlled by adjusting the operation time of the powder pump.

The powder pump through which the toner passes needs closeness to generate a pressure and the toner is necessarily frictionized with a part thereof. Some toners are stuck in the frictionized part and deteriorate. The deteriorated toners are not charged well in an image developer and causes foggy images. The toner of the present invention having an aggregation not greater than 20% and a circularity not less than 0.94 can prevent the foggy image. It is considered that this is because the toner having a shape close to a sphere and a low aggregation easily tumbles and is difficult to be stuck in the frictionized part of the powder pump.

An external additive may be added to effectively maintain the aggregation of the resultant toner not greater than 20%. Particularly, an inorganic material having a particle size not greater than 0.1 μm and a hydrophobized surface is preferably used as an external additive to make the aggregation of the resultant toner small. However, making the aggregation of the resultant toner small is not limited thereto according to the present invention.

To make the resultant toner have a circularity not less than 0.93, a pulverization method thereof is controlled when the toner is a pulverized toner. In addition, the toner may be heated to make the toner more spherical. A polymerization method of producing a toner includes a process of shaping the toner, in which a circularity of the resultant toner can be controlled. The pulverized toner has a circularity not greater than 0.92.

The toner according to the present invention is a dry toner capable of being used for both a one-component developer and a two-component developer, and has a volume-average particle diameter of from 3 to 15 μm. The toner of the present invention typically includes a binder resin and a colorant, and optionally includes a charge controlling agent, a wax, a magnetic material, an external additive, etc.

Specific examples of the binder resins according to the present invention include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modifiedrosins, terpene resins, aliphatic or alicyclic hydrocarbon resins, aromatic petroleum resins, chlorinated paraffin, paraffin waxes, etc. These resins may be used alone or in combination.

Specific examples of the colorants for the toner according to the present invention include any known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B. Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromiumoxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials may be used alone or in combination.

A content of the colorant in the toner is preferably from 0 to 50 parts by weight per 100 parts by weight of the binder resin.

To control a content of polar solvent soluble constituents in the toner, a content of polar solvent soluble constituents in impurities included in the pigment is preferably small.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes) BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) is used, but is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease in the image density of toner images.

Types of the charging controlling agents include many polar solvent soluble constituents in their main components or impurities. Materials including less polar solvent soluble constituents are preferably used for the charge controlling agents to decrease polar solvent soluble constituents in the resultant toner.

The toner according to the present invention may optionally include an external additive. Any known inorganic fine particles and hydrophobized inorganic fine particles maybe used as external additives. Specific examples of the external additives include silica fine particles, hydrophobized silica, fatty acid metallic salts such as zinc stearate and aluminium stearate, metal oxides such as titania, alumina, tin oxide and antimony oxide, fluoropolymers, etc.

In particular, the hydrophobized silica, titania and alumina fine particles are preferably used.

Specific examples of the silica fine particles include HDK H 2000, HDK H 2000/4, HDK H 2050EP and HVK21 from Hoechst AG; and R972, R974, RX200, RY200, R202, R805 and R812 from Nippon Aerosil Co.

Specific examples of the titania fine particles include P-25 from Nippon Aerosil Co.; ST-30 and STT-65C-S from Titan Kogyo K. K.; TAF-140 from Fuji Titanium Industry Co., Ltd.; MT150W, MT-500B and MT-600b from Tayca Corp., etc. Specific examples of the hydrophobized titanium oxide fine particles include T-805 from Nippon Aerosil Co.; STT-30A and STT-65S-S from Titan Kogyo K. K.; TAF-500T and TAF-1500T from Fuji Titanium Industry Co., Ltd.; MT-100S and MT100T from Tayca Corp.; IT-S from Ishihara Sangyo Kaisha Ltd., etc.

To prepare the hydrophobized silica fine particles, titania fine particles or alumina fine particles, hydrophilic fine particles are treated with silane coupling agents such as methyltrimethoxy silane, methyltriethoxy silane and octylmethoxy silane. Inorganic fine particles optionally treated with a silicone oil upon application of heat is preferably used.

Specific examples of the silicone oil include dimethyl silicone oil, methylphenyl silicone oil, chlorphenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acryl modified silicone oil, methacryl modified silicone oil, α-methylstyrene modified silicone oil, etc.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatomearth, chromium oxide, ceriumoxide, redironoxide, antimonytrioxide, magnesium oxide, zirconium oxide, barium sulfate, barium carbonate, calcium carbonate, silicon carbide, silicon nitride, etc., and particularly, silica and titanium dioxide are preferably used. A content of the inorganic fine particles is preferably from 0.1 to 5% by weight, and more preferably from 0.3 to 3% by weight based on the total weight of the toner.

The toner or developer according to the present invention preferably includes a wax to obtain releasability. The wax preferably has a melting point of from 40 to 120° C., and more preferably from 50 to 110° C. When the melting point is too high, the resultant toner may have insufficient low-temperature fixability. When the melting point is too low, offset resistance and durability of the resultant toner may be deteriorated. The melting point of the wax may be measured by a differential scanning calorimeter. Namely, a melting peak point of a sample of a few milligrams heated at a specific programming speed such as 10° C./min is a melting point. A content of the wax is preferably from 0 to 20 parts by weight, and more preferably from 0 to 10 parts by weight.

Specific examples of the wax include a solid paraffin wax, a micro wax, a rice wax, a fatty acid amide wax, a fatty acid wax, aliphatic mono ketone, a fatty acid metal salt wax, a fatty acid ester wax, a partially saponified fatty acid ester was, a silicone varnish, higher alcohol, a carnauba wax, etc. Polyolefin such as low-molecular-weight polyethylene and polypropylene can also be used. The polyolefin preferably has a melting point of from 70 to 150° C., and more preferably from 120 to 150° C. when measured by a ring and ball method.

A clean ability improver is preferably included in the toner or developer or added to a surface thereof to remove the toner or developer remaining on a photoreceptor and a first transfer medium after transfer. Specific examples of the cleanability improvers include fatty acid metal salts such as zinc stearate, sodium stearate and stearic acids; and polymer fine particles formed by a soap-free emulsifying polymerization method, such as polymethylmethacrylate fine particles and polystyrene fine particles. The polymer fine particles preferably have a comparatively narrow particle diameter distribution and a volume-average particle diameter of from 0.01 to 1 μm. A content of the cleanability improver is preferably from 0 to 5 parts by weight, and more preferably from 0 to 1 parts by weight.

The toner according to the present invention may include a magnetic material and can be used as a magnetic toner. Magnetic fine particles are included in the toner particles to prepare a magnetic toner. The specific examples of the magnetic materials include ferromagnetic metals or metal alloys such as irons such as ferrite and magnetite, nickel and cobalt or compounds including these elements; metal alloys without ferromagnetic elements, which become ferromagnetic when properly heated and are named Heusler alloys including manganese and copper such as manganese-copper-aluminium and manganese-copper tin; chromium dioxide, etc.

It is preferable that the magnetic material is uniformly dispersed and included as a fine powder having an average particle diameter of from 0.1 to 1 μm. A content of the magnetic material is preferably from 10 to 70 parts by weight, and more preferably 20 to 50 parts by weight per 100 parts by weight of the toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

After the following components were mixed by a mixer, the mixture was kneaded upon application of heat by a two-roll mixer and extended upon application of pressure and cooled to prepare a mixture 1. Next, the mixture 1 was pulverized by a pulverizer I-type mill using a collision board with a jet mill from Nippon Pneumatic Mfg. Co., Ltd., and classified by a spiral flow wind-force DS classifier from Nippon Pneumatic Mfg. Co., Ltd. to prepare a powder 1 having a volume-average particle diameter of about 6 μm. 1.0% by weight of a hydrophobic silica H2000 from Clariant (Japan) KK was mixed by a mixer with the powder 1 to prepare a toner 1.

| | |
|---|---|
| Polyester resin | 100 |
| Carbon black | 6 |
| E-84 from Orient Chemical Industries Co., Ltd.; | 2 |
| Carnauba wax | 3 |

Example 2

The procedures for preparing the toner 1 in Example 1 were repeated except for changing the hydrophobic silica to silica treated with an silicone oil RY50 from Nippon Aerosil Co. to prepare a toner 2.

Example 3

The procedures for preparing the toner 1 in Example 1 were repeated except for changing the pulverizer to a mechanical pulverizer Turbo Mill from TUROBO KOGYO CO., LTD. to prepare a toner 3.

Example 4

The procedures for preparing the toner 3 in Example 3 were repeated except for changing the hydrophobic silica to silica treated with an silicone oil RY50 from Nippon Aerosil Co. to prepare a toner 4.

Example 5

An aqueous phase 1, a prepolymer 1, a ketimine compound 1 and a pigment/wax dispersion liquid 1 were prepared in this order in the following methods and conditions, and the mixture was emulsified, a solvent was removed therefrom, washed and dried to prepare a toner 5.

[Aqueous phase 1]

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylic acid, 110 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to reach the temperature of 75° C. and reacted for 5 hrs. Further, 30 parts of an aqueous solution of persulfate ammonium having the concentration of 1% were added thereto and the mixture was reacted for 5 hrs at 75° C. to prepare an aqueous dispersion (a particulate dispersion liquid 1) of a vinyl resin (a copolymer of a sodium salt of an adduct of styrene-methacrylate-butylacrylate-sulfuric ester with ethyleneoxide methacrylate). The volume-average particle diameter of the particulate dispersion liquid 1 was measured by LA-920 as 105 nm. Apart of the particulate dispersion liquid 1 was dried to isolate a resin component therefrom. The resin component had a Tg of 59° C. and a weight-average molecular weight of 150,000.

990 parts of water, 83 parts of the particulate dispersion liquid 1, 37 parts of an aqueous solution of sodium dodecyldiphenyletherdisulfonate having the concentration of 48.5% (ELEMINOLMON-7 from Sanyo Chemical Industries, Ltd.) and 90 parts of ethyl acetate were mixed and stirred to prepare a lacteous liquid, i.e., an aqueous phase 1.

[Prepolymer 1]

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs under a normal pressure at 230° C. Further, after the mixture was depressurized by 10 to 15 mmHg and reacted for 5 hrs to prepare an intermediate polyester 1. The intermediate polyester 1 had a number-average molecular weight of 2,100, a weight-average molecular weight of 9,500, a Tg of 55° C. and an acid value of 0.5 and a hydroxyl value of 51.

Next, 410 parts of the intermediate polyester 1, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer 1. The prepolymer 1 includes a free isocyanate in an amount of 1.53% by weight.

[Ketimine Compound 1]

170 parts of isophorondiamine and 75 parts of methyl ethyl ketone were reacted at 50° C. for 5 hrs in a reaction vessel including a stirrer and a thermometer to prepare a ketimine compound 1. The ketimine compound 1 had an amine value of 418.

[Pigment/Wax Dispersion Liquid 1]

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were mixed and reacted in a reactor vessel including a cooling pipe, a stirrer and a nitrogen inlet pipe for 8 hrs under a normal pressure at 230° C. Further, after the mixture was depressurized by 20 to 65 mmHg and reacted for 5 hrs, 44 parts of phthalic acid anhydride were added thereto and reacted for 2 hrs at 180° C. under a normal pressure to prepare a low-molecular-weight polyester 1. The low-molecular-weight polyester 1 had a number-average molecular weight of 2,500, a weight-average molecular weight of 6,700, a Tg of 43° C. and an acid value of 25.

1,200 parts of water, 540 parts of carbon black Pintex 35 having an oil absorption of 42 ml/100 mg and a pH of 9.5 from degussa AG, 1,200 parts of a polyester resin were mixed by a Henschel mixer from Mitsui Mining Co., Ltd. After the mixture was kneaded upon application of heat by a two-roll mill at 150° C. for 3 min, the mixture was extended upon application of pressure and pulverized by a pulverizer to prepare a master batch 1.

378 parts of the low-molecular-weight polyester 1, 110 parts of carnauba wax, 22 parts of charge controlling agent (salicylic acid metal complex E-84 from Orient Chemical Industries Co., Ltd.) and 947 parts of ethyl acetate were mixed in a reaction vessel including a stirrer and a thermometer. The mixture was heated to 80° C. while stirred. After the temperature of 80° C. was maintained for 5 hrs, the mixture was cooled to 30° C. in an hour. Then, 500 parts of the master batch 1 and 500 parts of ethyl acetate were added to the mixture and mixed for 1 hr to prepare a material solution 1.

1,324 parts of the material solution 1 were put in another container, the carbon black and wax were dispersed using a beads mill Ultra Visco Mill from IMECS CO., LTD., at a liquid feeding speed of 1 kg/hr and a disc peripheral speed of 6 m/sec and three passes, in which 0.5 mm zirconia beads are used at 80% by volume. Next, 1,324 parts of an ethyl acetate solution of the low-molecular-weight polyester 1 having a concentration of 65% were added to the material solution 1 and the mixture was stirred by the beads mill once in the same conditions to prepare a pigment/wax dispersion liquid 1. The pigment/wax dispersion liquid 1 had a solid content of 50% at 130° C. for 30 min.

749 parts of the pigment/wax dispersion liquid 1, 115 parts of the prepolymer 1 and 2.9 parts of the ketimine compound 1 were mixed in a vessel by a T.K. homomixer from Tokushu Kika KogyoCo., Ltd. at 5,000 rpm for 1 min. 1,200 parts of the aqueous phase 1 were added to the mixture and mixed by the T.K. homomixer at 13,000 rpm for 20 min to prepare an emulsified slurry 1.

The emulsified slurry 1 was put in a vessel including a stirrer and a thermometer. After a solvent was removed from the emulsified slurry 1 at 30° C. for 8 hrs, the slurry was aged at 45° C. for 4 hrs to prepare a dispersion slurry 1. The dispersion slurry 1 had a volume-average particle diameter of 5.99 μm, and a number-average particle diameter of 5.70 μm when measured by Multisizer II.

After the dispersion slurry 1 was filtered under a reduced pressure, (1) 100 parts of ion exchanged water were added thereto and mixed by the T.K. homomixer at 12,000 rpm for 10 min, and the mixture was filtered to prepare a filtered cake;

(2) 100 parts of an aqueous solution of sodium hydrate was added to the filtered cake prepared in (1) and mixed by the T.K. homomixer at 12,000 rpm for 10 min, and the mixture was filtered under a reduced pressure;

(3) 100 parts of hydrochloric acid was added to the filtered cake prepared in (2) and mixed by the T.K. homomixer at 12,000 rpm for 10 min, and the mixture was filtered under a reduced pressure; and (4) 300 parts of ion exchanged water were added to the filtered cake prepared in (3) mixed by the T.K. homomixer at 12,000 rpm for 10 min, and the mixture was filtered twice to prepare a filtered cake 1. The filtered cake 1 was dried by an air drier at 45° C. for 48 hrs, and sieved by a mesh having an opening of 75 μm to prepare a powder 3 having a volume-average particle diameter of 6.0 μμm. The powder 3 was mixed by a mixer with 1.0% by weight of a hydrophobic silica H2000 from Clariant (Japan) KK to prepare a toner 5.

Example 6

The procedures for preparing the toner 5 in Example 5 were repeated except for changing the hydrophobic silica to silica treated with an silicone oil RY50 from Nippon Aerosil Co. to prepare a toner 6.

Example 7

The procedures for preparing the toner 5 in Example 5 were repeated except for increasing the rotational speed of the T.K. homomixer and a temperature when the solvent is removed to prepare a toner 7 having a smaller circularity.

Example 8

The procedures for preparing the toner 7 in Example 7 were repeated except for changing the hydrophobic silica to silica treated with an silicone oil RY50 from Nippon Aerosil Co. to prepare a toner 8.

Toner feeding tests were performed using the toners 1 to 8 in the feeders in FIGS. 3 and 8.

Results of the toner feeding tests, an aggregation and a circularity of each toner are shown in Table 1. The marks in Table 1 have the following meanings.

××: The toner could not be fed at all

×: The toner blockage occurred and the toner could not be fed on the way.

Δ: All of the toner in a bottle was fed, but the toner feeding occasionally stopped.

○: The toner was stably fed.

◎: The toner was stably fed, and an operation time, i.e., 0.1 to 1 sec of the powder pump was almost proportional to the fed amount of the toner.

Images were produced with a toner before fed, a toner fed by the toner feeder in FIG. 3 and a toner fed by the toner feeder in FIG. 8 to see whether foggy images were produced with the respective toners. The images having an image ratio of 10% were produced by Imagio Neo 450 equipped with a printer controller from Ricoh Company, Ltd. X-Rite 938 was used to measure an image density of a paper before printed and an image density of a background (non-image part) of the paper after printed to determine a difference therebetween. The results are shown in Table 2.

TABLE 1

| | Toner | Aggregation (%) | Circularity | Toner feeder in FIG. 3 | Toner feeder in FIG. 8 |
|---|---|---|---|---|---|
| Ex. 1 | Toner 1 | 12 | 0.915 | Δ | Δ |
| Ex. 2 | Toner 2 | 35 | 0.915 | XX | X |
| Ex. 3 | Toner 3 | 11 | 0.942 | ○ | ◎ |
| Ex. 4 | Toner 4 | 32 | 0.942 | Δ | Δ |
| Ex. 5 | Toner 5 | 14 | 0.973 | ○ | ◎ |
| Ex. 6 | Toner 6 | 27 | 0.973 | Δ | Δ |
| Ex. 7 | Toner 7 | 18 | 0.895 | X | X |
| Ex. 8 | Toner 8 | 32 | 0.896 | XX | X |

TABLE 2

| | Toner | Before fed | After fed by the feeder in FIG. 3 | After fed by the feeder in FIG. 8 |
|---|---|---|---|---|
| Ex. 1 | Toner 1 | 0.00 | 0.05 | 0.03 |
| Ex. 2 | Toner 2 | 0.05 | — | — |
| Ex. 3 | Toner 3 | 0.00 | 0.00 | 0.00 |
| Ex. 4 | Toner 4 | 0.05 | 0.11 | 0.08 |
| Ex. 5 | Toner 5 | 0.00 | 0.00 | 0.00 |
| Ex. 6 | Toner 6 | 0.05 | 0.21 | 0.07 |
| Ex. 7 | Toner 7 | 0.00 | 0.16 | 0.06 |
| Ex. 8 | Toner 8 | 0.05 | — | 0.21 |

Each of the toners 3 and 5 having an aggregation of not greater than 20% and a circularity not less than 0.93 was stably fed in the toner feeder in FIG. 3, and was also stably fed in the toner feeder in FIG. 8, and an operation time, i.e., 0.1 to 1 sec of the powder pump was almost proportional to the fed amount of the toner. No foggy image was produced before and after the toner was fed.

Each of the toners 1 and 7 having an aggregation of not greater than 20% but a circularity less than 0.93 in a bottle was fed in the toner feeders in FIGS. 3 and 8, but the toner feeding occasionally stopped. No foggy image was produced before the toner was fed, but foggy images were produced after fed. Similarly, each of the toners 4 and 6 having a circularity not less than 0.93 but an aggregation of greater than 20% in a bottle was fed in the toner feeders in FIGS. 3 and 8, but the toner feeding occasionally stopped. Foggy images were produced before the toner was fed, and foggy image became worse after fed.

Each of the toners 2 and 8 having a different aggregation % and a different circularity from those of the present invention could not have been fed at all in the toner feeder in FIG. 3, and there was toner blockage in the tube and the toner cold not have been fed on the way to the toner feeder in FIG. 8. Foggy images were produced before the toner was fed, and foggy images became worse after fed.

This document claims priority and contains subject matter related to Japanese Patent Application No. 2003-003171 filed on Jan. 9, 2003, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic image forming apparatus comprising:

a photoreceptor;

a charger configured to charge the photoreceptor;

an irradiator configured to irradiate the photoreceptor with light to form an electrostatic latent image on the photoreceptor;

an image developer configured to develop the electrostatic latent image with a developer comprising a toner comprising toner powders having an aggregation not greater than 20% and circularity not less than 0.93; and a toner feeder comprising a container configured to contain the toner prior to use in the developer, a pipe configured to transport the toner, and a pump configured to feed the toner from the container through the pipe, wherein the pump feeds the toner to the image developer through the pipe and comprises a screw pump having a female screw stator having a double-pitch spiral groove on an inner surface thereof, and a male rotor rotatably inserted into the female screw stator.

2. The electrophotographic image forming apparatus of claim 1, wherein the developer is a two-component developer comprising a carrier and the toner, and wherein a concentration of the toner in the two-component developer is controlled by changing an output power of the pump.

* * * * *